US010808481B2

(12) United States Patent
Schultz, Jr.

(10) Patent No.: US 10,808,481 B2
(45) Date of Patent: Oct. 20, 2020

(54) APPARATUS AND METHOD FOR CUTTING CASINGS

(71) Applicant: Weatherford Technology Holdings, LLC, Houston, TX (US)

(72) Inventor: William Allen Schultz, Jr., Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 154 days.

(21) Appl. No.: 15/815,594

(22) Filed: Nov. 16, 2017

(65) Prior Publication Data

US 2019/0145211 A1 May 16, 2019

(51) Int. Cl.

| | |
|---|---|
| ***E21B 29/00*** | (2006.01) |
| *E21B 17/10* | (2006.01) |
| *E21B 33/13* | (2006.01) |

(52) U.S. Cl.

CPC ..... *E21B 29/005* (2013.01); *E21B 17/1014* (2013.01); *E21B 33/13* (2013.01)

(58) Field of Classification Search

CPC ..... E21B 29/05; E21B 29/005

See application file for complete search history.

(56) References Cited

U.S. PATENT DOCUMENTS 1,777,713 A * 10/1930 Braden ..... E21B 29/005 166/55.8
1,814,048 A 7/1931 Lincoln
1,868,757 A * 7/1932 Myracle ..... E21B 29/005 166/55.8
2,275,946 A * 3/1942 Childers ..... E21B 29/005 166/55.8
2,284,170 A * 5/1942 Santiago ..... E21B 10/322 175/269
3,050,122 A * 8/1962 Huitt ..... E21B 10/322 166/55.8

(Continued)

FOREIGN PATENT DOCUMENTS

EP 2530238 A1 12/2012

OTHER PUBLICATIONS

PCT International Search Report and Written Opinion dated Feb. 11, 2019, for International Application No. PCT/US2018/061320.

*Primary Examiner* — William D Hutton, Jr.
*Assistant Examiner* — Steven A MacDonald
(74) *Attorney, Agent, or Firm* — Patterson + Sheridan, LLP

(57) ABSTRACT

A tool for cutting a tubular includes a housing, a first blade having a first cutting surface, and a second blade having a second cutting surface. The first blade and the second blade are configured to move between an extended position and a retracted position. The first blade and the second blade are disposed in the housing in the retracted position. The first cutting surface and the second cutting surface overlap in the retracted position. In another embodiment, a tool for cutting a tubular in a wellbore, includes a housing having a longitudinal axis; a pin connected to the housing and disposed on a first side of the longitudinal axis; and a blade including a cutting surface, the blade configured to move between an extended position and a retracted position about the pin, wherein the cutting surface is disposed at least in part on a second side of the longitudinal axis in the retracted position.

9 Claims, 10 Drawing Sheets

(56) References Cited

U.S. PATENT DOCUMENTS

| | | | | | |
|---|---|---|---|---|---|
| 3,331,439 | A * | 7/1967 | Sanford | E21B 29/005 | 166/55.8 |
| 4,068,711 | A | 1/1978 | Aulenbacher | | |
| 4,411,324 | A | 10/1983 | Liebig | | |
| 5,036,921 | A * | 8/1991 | Pittard | E21B 10/322 | 166/298 |
| 5,060,738 | A | 10/1991 | Pittard et al. | | |
| 5,150,755 | A * | 9/1992 | Cassel | B23B 5/16 | 166/297 |
| 5,201,817 | A * | 4/1993 | Hailey | E21B 10/322 | 166/55.8 |
| 5,242,017 | A * | 9/1993 | Hailey | E21B 10/322 | 166/55.8 |
| 5,265,675 | A * | 11/1993 | Hearn | E21B 10/322 | 166/297 |
| 5,350,015 | A | 9/1994 | Hailey | | |
| 5,791,409 | A | 8/1998 | Flanders | | |
| 7,581,591 | B2 | 9/2009 | Schwindt | | |
| 9,175,534 | B2 * | 11/2015 | McAfee | E21B 44/00 | |
| 2005/0133224 | A1 * | 6/2005 | Ruttley | E21B 29/005 | 166/298 |
| 2016/0010413 | A1 | 1/2016 | Stokes et al. | | |
| 2016/0168924 | A1 * | 6/2016 | Glaser | E21B 17/1014 | 166/376 |
| 2016/0312561 | A1 * | 10/2016 | Miller | E21B 29/005 | |

* cited by examiner

APPARATUS AND METHOD FOR CUTTING CASINGS

BACKGROUND OF THE INVENTION

Field of the Invention

The present disclosure generally relates to apparatus and method for cutting casing in a wellbore.

Description of the Related Art

A wellbore is formed to access hydrocarbon bearing formations, for example crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung form the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with the drill string. The drill string is removed. A first string of casing is then run into the wellbore and set in the drilled-out portion of the wellbore, and cement is circulated into the annulus behind the casing string. Next, the well is drilled to a second designated depth, and a second string of casing or liner, is run into the drilled-out portion of the wellbore. If the second string is a liner string, the liner is set at a depth such that the upper portion of the second string of casing overlaps the lower portion of the first string of casing. The liner string may then be fixed, or "hung" off of the existing casing by the use of slips which utilize slip members and cones to frictionally affix the new string of liner in the wellbore. If the second string is a casing string, the casing string may be hung off of a wellhead. This process is typically repeated with additional casing/liner strings until the well has been drilled to total depth. In this manner, wells are typically formed with two or more strings of casing/liner of an ever-decreasing diameter.

From time to time, for example once the hydrocarbon-bearing formations have been depleted, the wellbore must be plugged and abandoned (P&A) using cement plugs. This P&A procedure seals the wellbore from the environment, thereby preventing wellbore fluid, such as hydrocarbons and/or salt water, from polluting the surface environment. This procedure also seals sensitive formations, such as aquifers, traversed by the wellbore from contamination by the hydrocarbon-bearing formations. Setting of a cement plug when there are two adjacent casing strings lining the wellbore is presently done by cutting a window in each of the adjacent casing strings and squeezing cement into the windows to provide a satisfactory seal.

After the wellbore has been plugged, the sub-sea wellhead may be retrieved. A tool is lowered down and secured to the wellhead. A casing cutter of the tool is used to make a cut through the casing strings attached to the wellhead. The wellhead and the portion of the casing strings attached to the wellhead above the cut are then retrieved to the surface with the tool.

A casing cutter is used to make a cut above the placement of the cement plug and separate the casing into a first or upper portion and a second or lower portion. Conventional casing cutters have straight blades extending diagonally outwards towards the casing string(s), such as the casing cutter 5 shown in FIG. 1. The straight blades are pivotally mounted to the body of the cutting tool and disposed symmetrically about the cutting tool. The blades are actuated and pivot outward, cutting the casing in the process. The straight blades cut on a diagonal cutting surface through the casing string(s) and cement. As the straight blades extend outward to cut outer casing string(s), the straight blade continues to cut previous inner casing string(s), as shown in FIG. 1. The straight blades cut out a hemisphere of material around the casing cutter. The large amount of material required to be cut by using conventional straight blades increases time and cost of abandonment operations and often damages conventional blades, thereby decreasing reliability. In addition, the adjacent casing strings may not be concentric, requiring larger straight blades to ensure the outermost casing string is cut fully. There is a need, therefore, for apparatus and method for cutting casings which reduces the amount of material cut, lowers costs, and lowers time for cutting operations.

SUMMARY OF THE INVENTION

A tool for cutting a tubular in a wellbore includes a housing, a first blade having a first cutting surface, and a second blade having a second cutting surface. The first blade and the second blade are configured to move between an extended position and a retracted position. The first blade and the second blade are disposed in the housing in the retracted position. The first cutting surface and the second cutting surface overlap in the retracted position.

A tool for cutting a tubular in a wellbore includes a housing and a blade configured to move between an extended position and a retracted position. The blade includes a curved portion having a cutting surface disposed on at least a part of the curved portion. The radius of curvature of the curved portion is substantially similar to an outer diameter of the housing.

A tool for cutting a tubular in a wellbore includes a housing having a first window and a second window formed through a wall of the housing, a pin disposed adjacent the first window, and a blade configured to rotate about the pin between an extended position and a retracted position, the blade having a curved portion disposed adjacent the second window in the retracted position.

A method for cutting a tubular includes positioning a rotatable cutting tool in the tubular, the cutting tool having a housing and a blade with a cutting surface disposed thereon. The method includes rotating the blade about a pin through a window formed in the housing.

A method of cutting a tubular includes positioning a rotatable cutting tool in the tubular, the cutting tool having a housing and a blade with a cutting surface disposed thereon. The method includes moving the blade between a retracted position, wherein at least a portion of the cutting surface is disposed on a first side of a longitudinal axis of the housing, and an extended position wherein at least a portion of the cutting surface is disposed on a second side of the longitudinal axis. The method further includes rotating the cutting tool relative to the tubular and cutting the tubular using the cutting surface.

In another embodiment, a tool for cutting a tubular in a wellbore, includes a housing having a longitudinal axis; a pin connected to the housing and disposed on a first side of the longitudinal axis; and a blade configured to move between an extended position and a retracted position about the pin, wherein the blade includes a cutting surface disposed thereon, the cutting surface disposed at least in part on a second side of the longitudinal axis in the retracted position.

In another embodiment, a method of cutting a tubular includes positioning a rotatable cutting tool in the tubular, the cutting tool having a housing and a blade, the blade including a cutting surface disposed thereon; moving the blade between a retracted position, wherein at least a portion of the cutting surface is disposed on a first side of a longitudinal axis of the housing, and an extended position, wherein the portion of the cutting surface is disposed on a second side of the longitudinal axis; rotating the cutting tool relative to the tubular; and cutting the tubular using the blade.

In yet another embodiment, a method of cutting a tubular includes positioning a rotatable cutting tool in the tubular, the cutting tool having a housing and a blade, the blade including a cutting surface; moving a portion of the cutting surface of the blade between a first side of a longitudinal axis of the housing and a second side of the longitudinal axis; rotating the cutting tool relative to the tubular; and cutting the tubular using the blade.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a longitudinal axis of a wellbore, and "below", "lower", "downward" and similar terms refer to a direction away from the earth's surface along the longitudinal axis of the wellbore.

Figure 1:
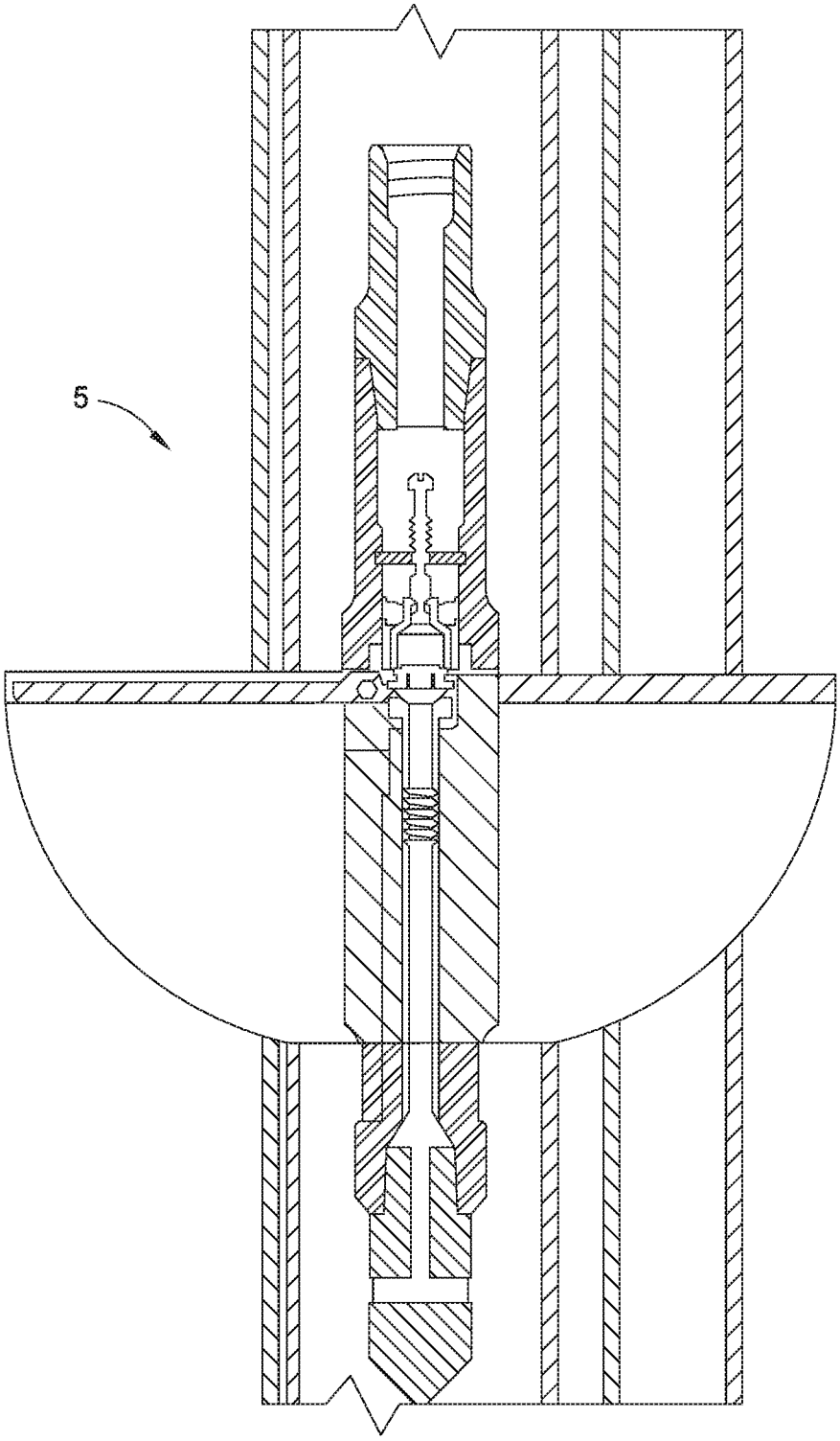
FIG. 1 ( PRIOR ART )
FIG. 1 illustrates the cutting path of a conventional casing cutter.
Figure 2A:
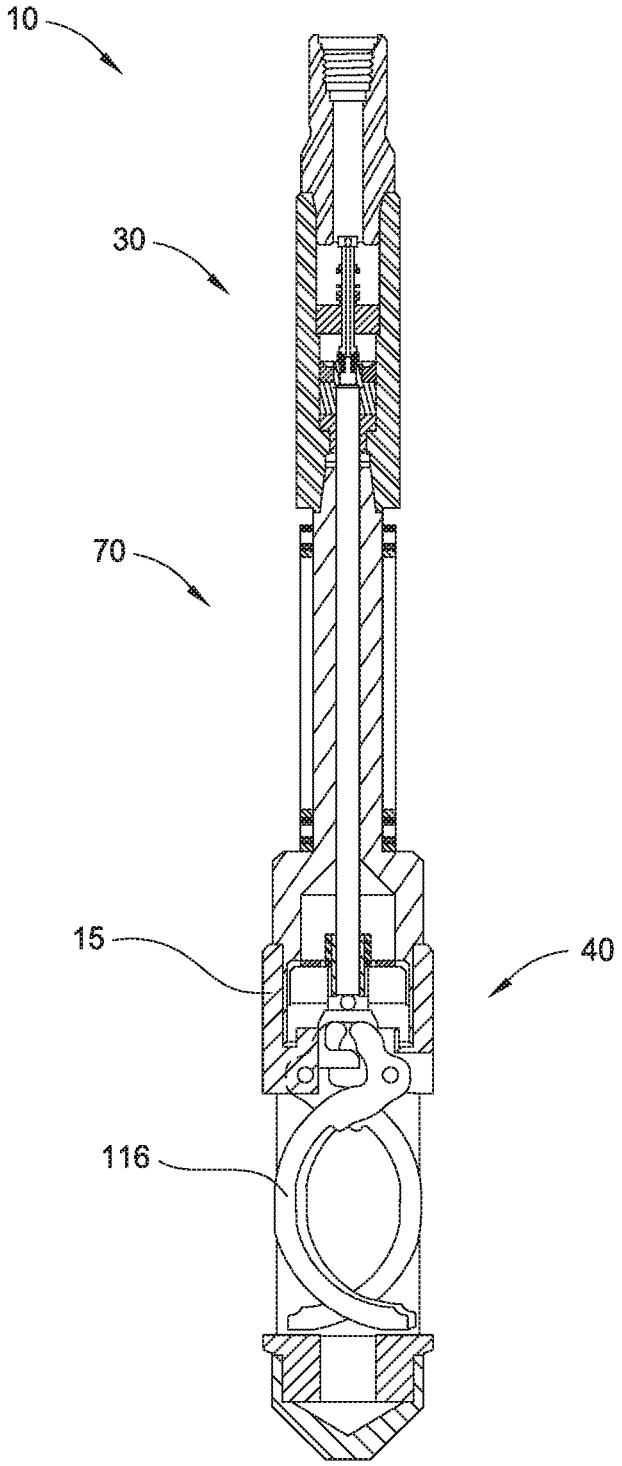
FIG. 2A illustrates a cross-sectional view of an embodiment of a tool for cutting a tubular, in a first or retracted position.
Figure 3A:
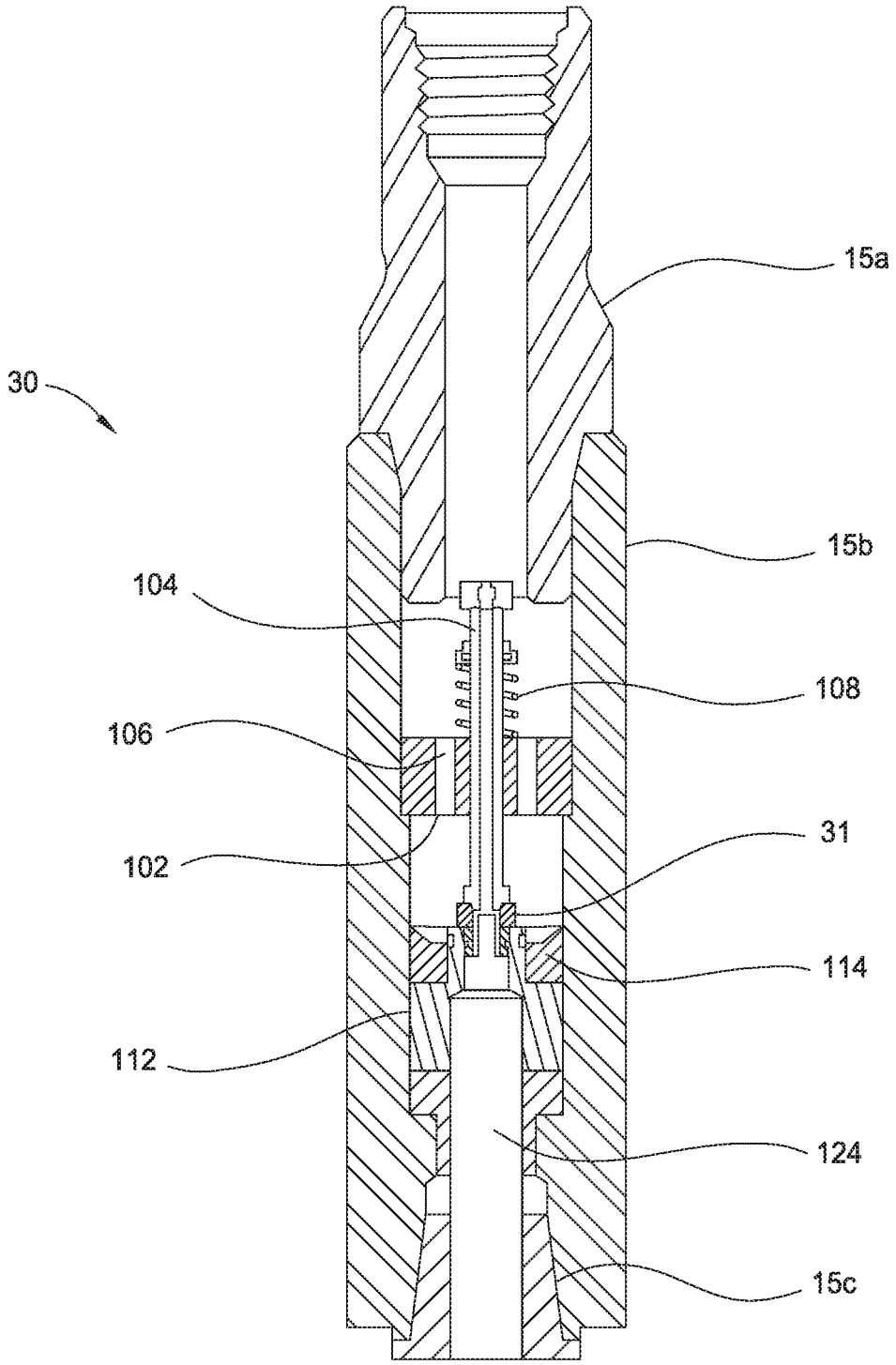
FIG. 3A illustrates a cross-sectional view of an actuation assembly of the tool.
Figure 3B:
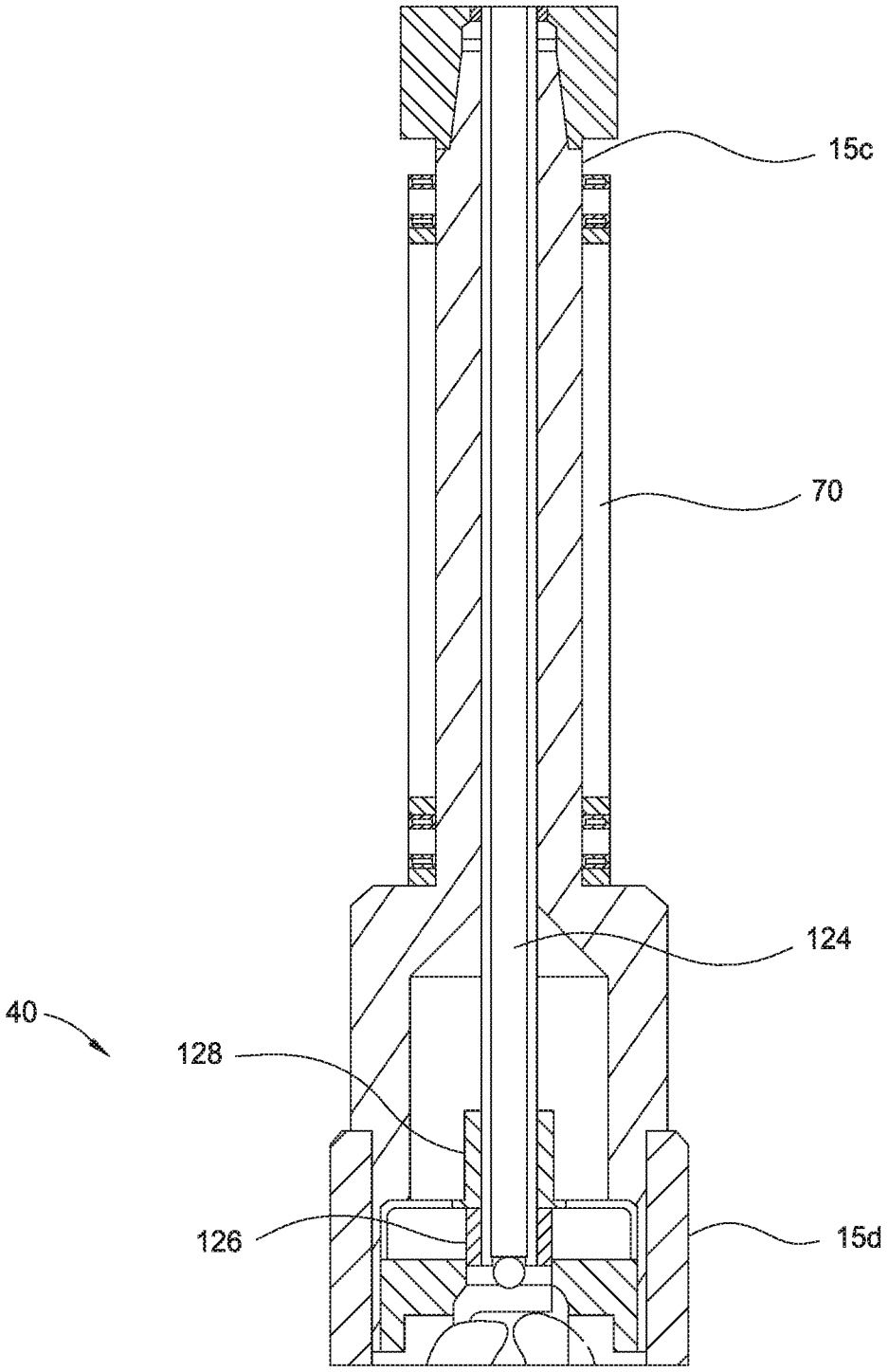
FIG. 3B illustrates a cross-sectional view of a stabilizer assembly of the tool.
Figure 3C:
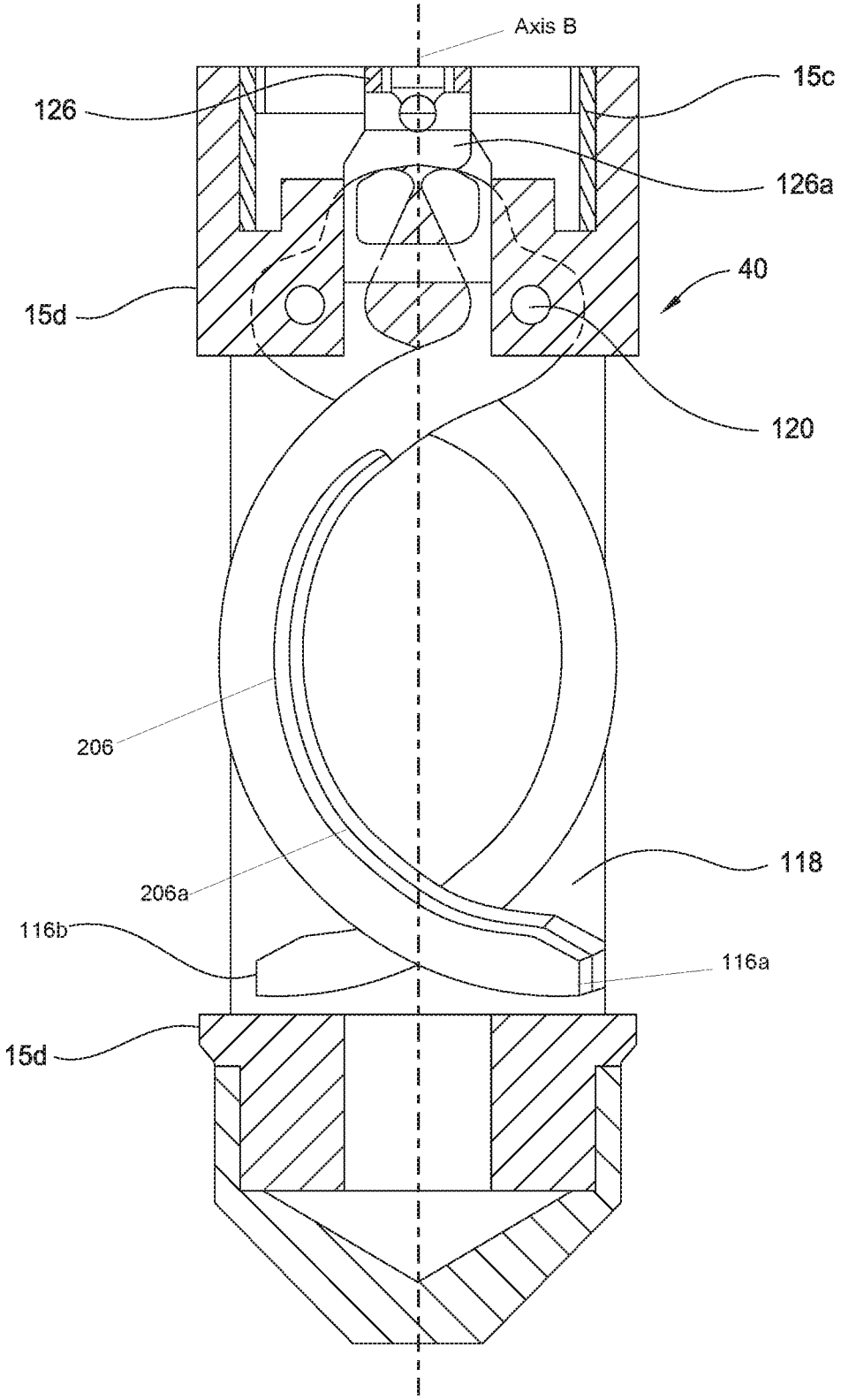
FIG. 3C illustrates a cross-sectional view of a blade assembly of the tool, in the first or retracted position.

FIG. 2A illustrates a rotatable cutting tool 10 for cutting a tubular in a wellbore 20. The tubular may be an inner tubular 50 at least partially disposed in an outer tubular 60, as shown in FIG. 2A. However, tool 10 may be equally well used in tubulars that are not surrounded by any other tubulars. Exemplary tubulars include casing, liner, drill pipe, drill collars, coiled tubing, production tubing, pipeline, riser, and other suitable wellbore tubulars. The tool includes an actuation assembly 30 and a blade assembly 40 both shown in FIG. 2A positioned in a housing 15. The housing 15 may be tubular having a bore therethrough. The housing 15 may include one or more sections 15*a-d,* as shown in FIGS. 3A-C. The housing sections 15*a-d* may be connected at longitudinal ends thereof. The housing section 15*a* may be connected at an upper longitudinal end to a workstring. The tool 10 may be lowered into the wellbore 20 on the workstring. The tool 10 is configured to be disposed within a tubular such that the longitudinal axis of the tool is essentially parallel (within +/− 10 degrees) with the longitudinal axis of the tubular. The tool 10 is configured to rotate about its longitudinal axis.

The actuation assembly 30 acts to extend blades 116*a,b* of the blade assembly 40. The actuation assembly may be at least partially disposed in the bores of the housing sections 15*b-d.* In one embodiment, actuation assembly 30 includes a retaining member 102 having at least one aperture 106 and a bore therethrough, as seen in FIG. 3A. The bore of the retaining member 102 is configured to receive a movable member 104. The movable member 104 includes a bore therethrough. In one embodiment, the movable member 104 is biased upward, for example by a spring 108. The movable member 104 includes a thick bottom portion that prevents disengagement from the retaining member 102. In one embodiment, a bottom surface of the movable member 104 is initially sealingly engaged with a bushing 31 which is threadedly engaged with an actuator piston 112, each having a bore therethrough. The bore of the bushing 31 and the actuator piston 112 have a larger diameter than the bore of the movable member 104. The actuator piston 112 includes a packing seal 114 for preventing fluid flow around the actuator piston 112. In one embodiment, the actuator piston 112 is biased upward against the bottom surface of the movable member 104, for example by a spring. A mandrel 124 may be threadedly connected to the actuator piston 112 at an upper longitudinal end. The mandrel 124 may be tubular and threadedly connected to a blade piston 126 at a lower longitudinal end, opposite the actuator piston 112. In one embodiment, the blade piston 126 is biased upward against the lower longitudinal end of the mandrel 124, for example by a spring. The blade piston 126 may include a shoulder 126*a.* The shoulder 126*a* may be configured to receive the blades 116*a,b* in a corresponding inner recessed region. The shoulder 126*a* may have a lower lip and an upper lip. In one embodiment, the shoulder 126*a* of the blade piston 126 may include an equal number of inner recessed regions, lower lips, and upper lips for each blade 116*a,b*. A sleeve 128 may be disposed about an upper portion of the blade piston 126. The sleeve 128 may be disposed in the housing section 15*d*. The sleeve 128 may be threadedly connected to an outer surface of the blade piston 126. The sleeve 128 may be longitudinally movable with the blade piston 126 between a first or upper position, shown in FIG. 3B, and a second or lower position, shown in FIG. 5B. The sleeve 128 may be configured to prevent hydraulic lock of the actuator assembly. For example, the sleeve 128 may have apertures formed therethrough. The apertures of the sleeve 128 may permit fluid communication through the sleeve and prevent excess fluid pressure acting on the sleeve.

Figure 2B:
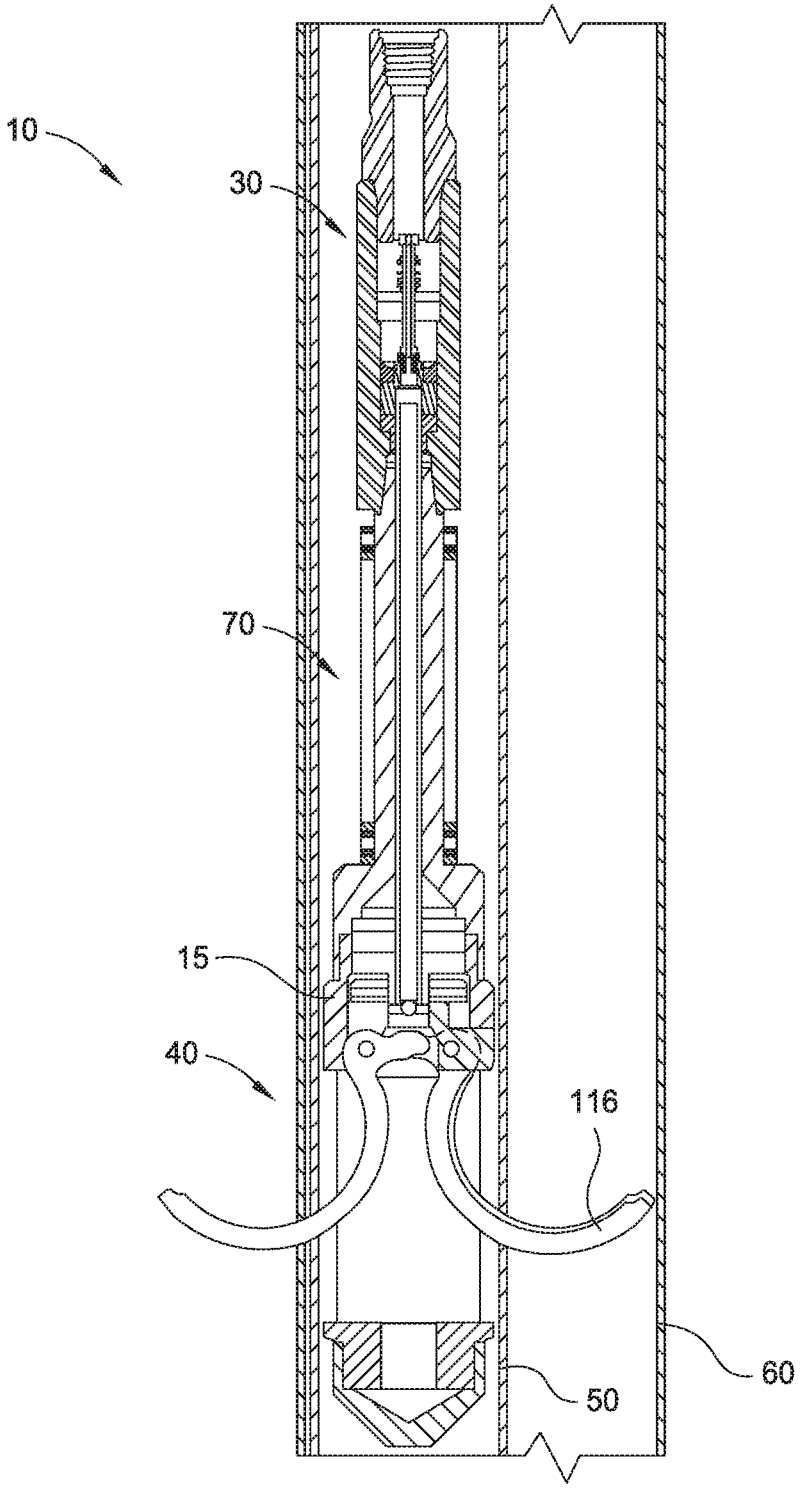
FIG. 2B illustrates a cross-sectional view of the tool, in a second or extended position.
Figure 5A:
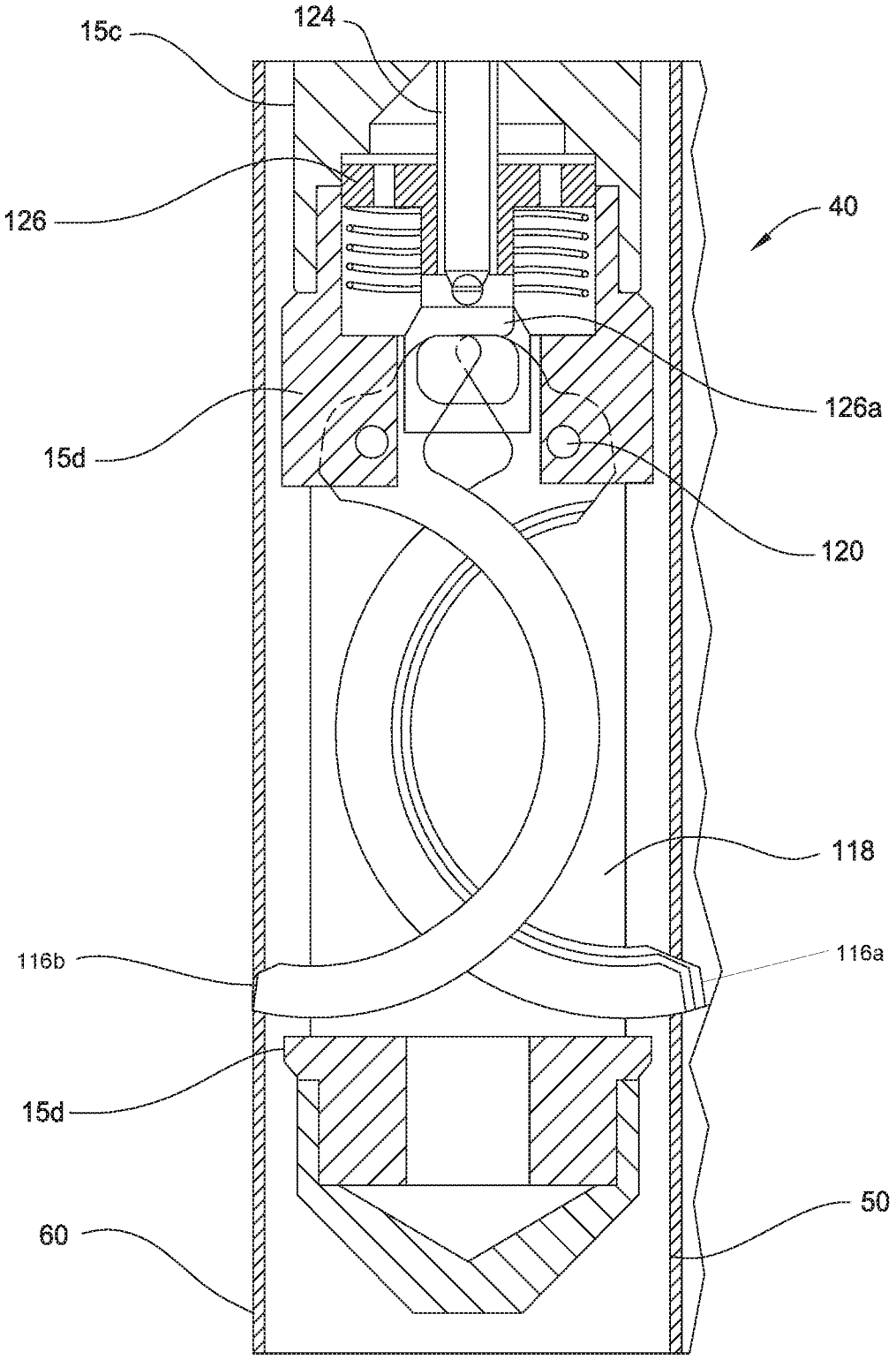
FIG. 5A illustrates a cross-sectional view of the blade assembly of the tool, in an extended position.
Figure 5B:
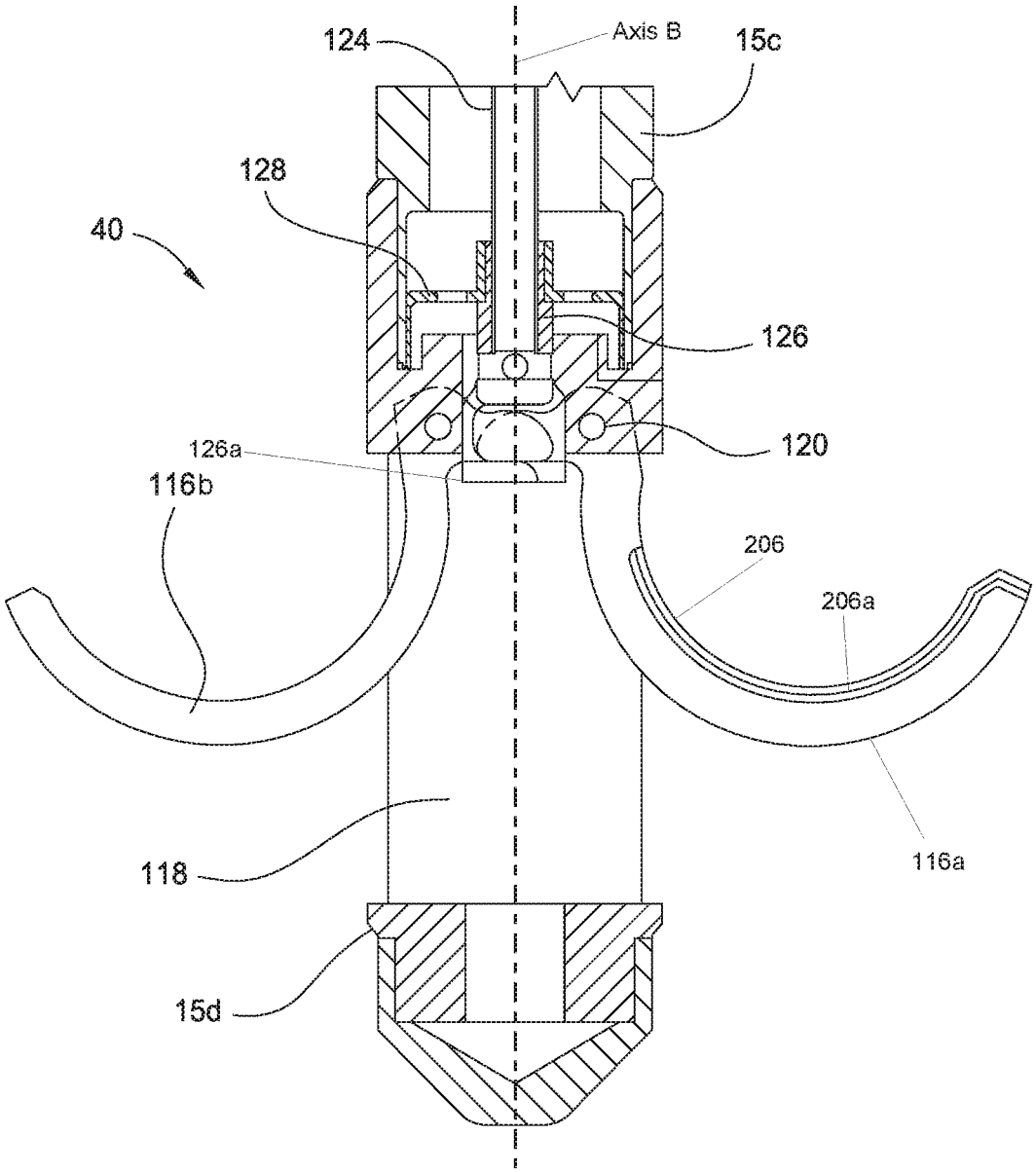
FIG. 5B illustrates a cross-sectional view of the blade assembly of the tool, in a further extended position.

The blade assembly 40 includes at least one blade 116 in a respective recess 118 of the housing section 15*d*, as shown in FIG. 3C. The recess 118 may be formed in a bore of the housing section 15*d*. The blades 116*a,b* may be disposed in the bore of the housing section 15*d*. Any appropriate number of blades 116 may be used in the blade assembly 40. In some embodiments, the number of blades 116 ranges from 1 to 4. Each blade 116*a,b* is rotatable with respect to the tool 10, about a pin 120, between a retracted position (FIGS. 2A and 3C) and a series of extended positions (FIGS. 2B and 5A-B). The pin 120 may be disposed in the housing section 15*d*. The housing section 15*d* may have a window formed through a wall thereof. The housing section 15*d* may have a window for each corresponding blade 116*a,b*. The blades 116*a,b* may be configured to at least partially exit the recess 118 through the windows when moving to the extended position. The pin 120 may be disposed adjacent the blade piston 126. The pin 120 may be disposed adjacent the corresponding window through which the blade 116*a* exits the recess 118. The pin 120 may be disposed on a first side of a longitudinal axis B of the housing section 15*d*, as shown in FIGS. 3C, 5B. The pin 120 may be connected to the housing 15 and disposed on the first side of the longitudinal axis B opposite the corresponding cutting surface of the blade. The pin 120 may be at least partially disposed through a shoulder of the housing section 15*d*. The pin 120 may be disposed adjacent the shoulder 126*a* of the blade piston 126. In the retracted position, the blade 116 is disposed in the recess 118. In the retracted position, the blade 116 is disposed in the bore of the housing section 15*d*. In the extended positions, the blade 116 is at least partially extended outward from the recess 118. In some embodiments, the blade 116 extends radially outward from the longitudinal axis of the cutting tool 10. In one embodiment, the blades 116*a,b* are biased towards the retracted position, for example by the spring acting on the blade piston 126. The weight of blade 116*a* may cause the blade 116*a* to rotate about the pin 120 towards the retracted position. A person of ordinary skill in the art with the benefit of this disclosure would appreciate that other configurations of blade assemblies 40 and actuator assemblies 30 could serve to provide one or more blades that move from a retracted position to an extended position within the spirit of this disclosure.

The tool 10 may optionally include a stabilizer assembly 70, as shown in FIG. 3B. The stabilizer assembly 70 may be disposed between the blade assembly 40 and the actuation assembly 30. Alternatively, the stabilizer assembly may be disposed about the blade assembly 40 and the actuation assembly 30. The stabilizer assembly 70 may include a stabilizer configured to stabilize the tool 10 inside the innermost tubular during a cutting operation. An exemplary stabilizer assembly is disclosed in U.S. patent application Ser. No. 14/569,414, which is hereby fully incorporated by reference. The mandrel 124 may extend through a bore of the stabilizer assembly 70. In another embodiment, the tool 10 may not include the stabilizer assembly 70. In this example, the mandrel 124 and blade piston 126 may not be included in the tool 10. Instead, the actuator piston 112 may include a shoulder similar to the shoulder 126*a* of the blade piston 126. The shoulder of the actuator piston 112 may be configured to receive the blades 116*a,b* in a corresponding inner recessed region. The shoulder of the actuator piston 112 may include an inner recessed region, a lower lip, and an upper lip. The shoulder of the actuator piston 112 may include an equal number of inner recessed regions, lower lips, and upper lips for each blade.

Figure 4A:
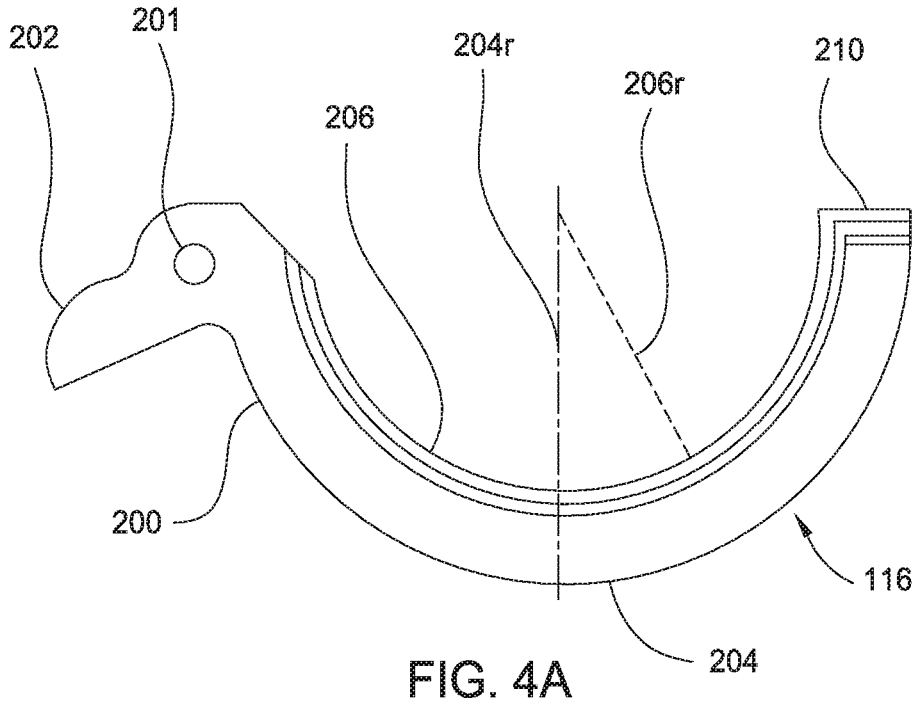
FIG. 4A illustrates an exemplary embodiment of a blade of the tool.
Figure 4B:
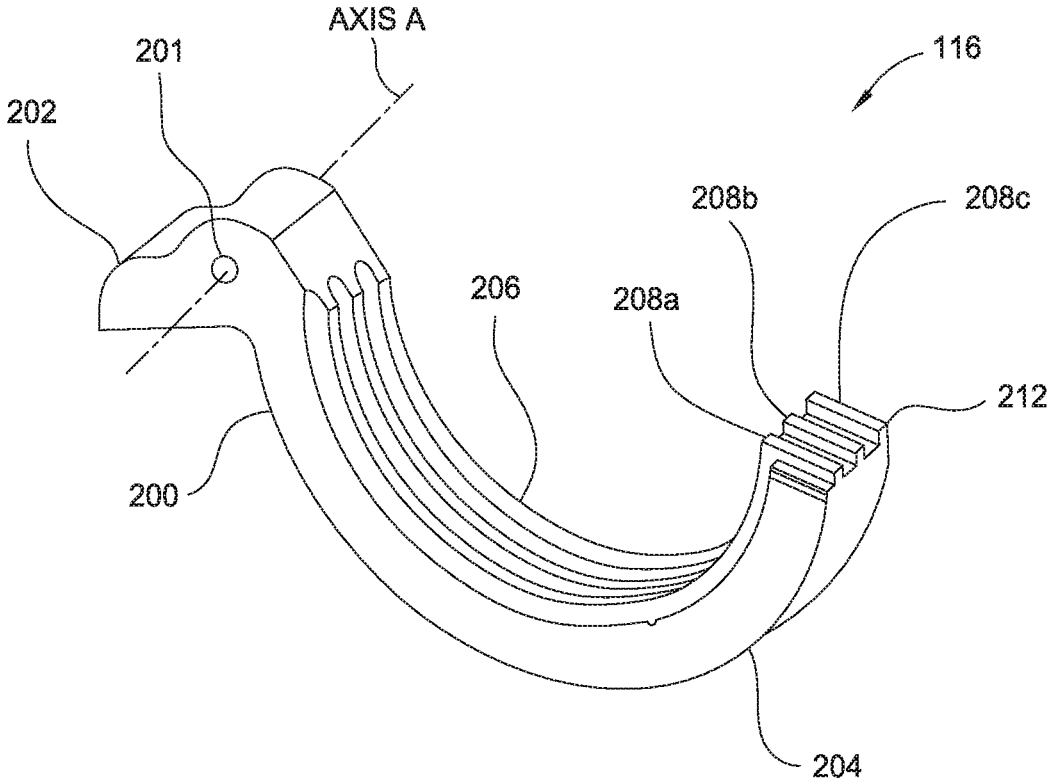
FIG. 4B illustrates an isometric view of the blade of FIG. 4A.

An exemplary embodiment of the blade 116 is shown in FIGS. 4A and 4B. The blade 116 includes a blade body 200 with an aperture 201 for receiving a pivot pin at pin 120. The blade body 200 may include a wall. The aperture 201 may be formed through the wall of the blade body 200. The blade body 200 may include a shoulder 202 and a curved portion 204. The aperture 201 may be located at an end of the curved portion 204. The curved portion 204 may have an outer, convex surface and an inner, concave surface. The convex surface of the curved portion 204 may face laterally outwardly from the housing in the retracted position. The concave surface of the curved portion 204 may face laterally inwardly of the housing in the retracted position. The curved portion 204 may be an arcuate segment. In one embodiment, the curved portion 204 may include a plurality of straight segments. Each subsequent straight segment may be angled relative to a previous straight segment. The curved portion 204 may be substantially semi-circular (within +/− ninety degrees of a semi-circle). The curved portion 204 may include a cutting surface 206. The cutting surface 206 may be disposed on the blade 116. The cutting surface 206 may be disposed on the inner, concave surface of the curved portion 204. The cutting surface 206 may face radially inwardly in the retracted position. The cutting surface 206 may extend to an end of the curved portion 204 opposite the aperture 201. The cutting surface 206 may be disposed on a corner 210 of the blade 116. The cutting surface 206 may include any material suitable for cutting a tubular. For any given tubular, the cutting surface 206 may include any suitable material that is at least as hard as the material of the inner surface of that tubular. The cutting surface 206 may include one or more cutting elements 208*a-c*. The one or more cutting elements 208*a-c* may be tiered cutting elements. The cutting element 208*c* may extend further from the blade body 200 than the cutting elements 208*a* and 208*b*. The cutting element 208*b* may extend further from the blade body 200 than the cutting element 208*a*. An exemplary tiered cutting element is disclosed in UK Patent Application No. GB1705993.2, which is hereby fully incorporated by reference. The cutting surface 206 may include a radius of curvature 206*r* on an innermost surface of the cutting surface 206. In one embodiment, the radius of curvature 206*r* may vary along the cutting surface 206. The radius of curvature 206*r* may be substantially (within +/− thirty percent) uniform. The curved portion 204 may include a radius of curvature 204*r*. In one embodiment, the radius of curvature 204*r* may vary along the curved portion 204. The radius of curvature 204*r* may be substantially (within +/− thirty percent) uniform. The radius of curvature 204*r* of the curved portion 204 may be greater than the radius of curvature 206*r* of the cutting surface 206.

The cutting surface 206 may be configured to cut a tubular, such as the inner tubular 50. In some embodiments, the cutting surface 206 is configured to cut through a tubular, thereby making a full-thickness cut. In some embodiments, the blade 116 includes a pivot pin in aperture 201 along axis A. In some embodiments, as the blade 116 extends radially outward from the longitudinal axis of cutting tool 10, the cutting surface 206 moves upward within the nested tubulars. Consequently, the amount of extension of the blade 116 from the cutting tool 10 may be expressed as a measurement of rotation angle about axis A. The cutting surface 206 cuts the inner tubular 50 when the blade 116 is in an extended position. An edge 212 of the cutting surface 206 may engage the inner tubular 50. The edge 212 may be disposed at an end of the corner 210 opposite the curved portion 204. The sweep of the tool 10 is the diameter of a circle formed by the edge 212 as the tool 10 rotates about its longitudinal axis. The edge 212 may include an initial engagement point configured to engage a surrounding tubular. The edge 212 of the cutting surface 206 may make initial contact with a surrounding tubular.

In cutting to the fully extended position, the blades 116*a,b* may remove material substantially equivalent to a hemisphere having a radius equivalent to the radius of curvature 204*r* minus the volume of the borehole of the wellbore and minus half the volume of a toroid having a minor radius equivalent to the radius of curvature 206*r* and a major radius equivalent to the sum of the distance from the longitudinal axis of the tool 10 to the pin 120 and the radius of curvature 206*r*.

During operation, the tool 10 may be lowered into the inner tubular 50 with the blades 116*a,b* in the retracted position. In one embodiment, the blades 116*a,b* may be completely disposed in the housing 15 in the retracted position. An outer diameter of the housing section 15*d* may be substantially similar (within +/− thirty percent) to the radius of curvature 204*r* of the blade 116, such that the blades 116*a,b* are at least partially disposed in the housing section 15*d* in the retracted position. The blades 116*a,b* may laterally overlap in the retracted position, as shown in FIGS. 2A and 3C. The cutting surfaces 204 of the blades 116*a,b* may face inwards of the housing 15 in the retracted position. The cutting surface 206 of one of the blades 116*a,b* may face towards a cutting surface 206 of another of the blades 116*a* in the retracted position. The curved portion 204 of the blade 116*a* may be disposed at least in part on a second side of the longitudinal axis B of the housing 15 opposite the corresponding pin 120. In one embodiment, the tubular 50 is tubing disposed in casing. In another embodiment, the inner tubular 50 is casing/liner disposed in the wellbore 20. In yet another embodiment, the inner tubular 50 is an inner casing/liner disposed in an outer casing/liner, such as outer tubular 60, as shown in FIG. 2A. Cement may or may not be disposed on an outer surface of any one or more of the nested tubulars. In one embodiment, the inner tubular 50 and the outer tubular 60 are concentrically aligned in the wellbore 20. In another embodiment, the inner tubular 50 and the outer tubular 60 are not concentrically aligned, as shown in FIG. 2A. The tool 10 may be positioned at a desired depth. As shown in FIG. 2A, the inner and outer tubulars 50, 60 may overlap at the desired depth. Thereafter, the blades 116*a,b* may be extended outwardly relative to the longitudinal axis of the cutting tool 10, as shown in FIGS. 2B, 5A, and 5B.

Actuation assembly 30 may act to extend blades 116*a,b* of the blade assembly 40. In some embodiments, actuation assembly 30 is hydraulic. To actuate the blades 116*a,b* into an extended position, fluid is injected through the tool 10. A first portion of the injected fluid enters the bore of the movable member 104 before entering the larger bore of the actuator piston 112. Thereafter, the first portion of fluid passes through the mandrel 124, through a bore of the blade piston 126, and exits the tool 10 through the recess 18 of the housing 15. A second portion of the injected fluid passes through the apertures 106 of the retaining member 102 and may act on the packing seal 114 of the actuator piston 112. Fluid pressure in the housing 15 is increased, thereby moving the movable member 104 downward and compressing the spring 108 against the retaining member 102. In turn, the movable member 104 urges the actuator piston 112 downward. In turn, the actuator piston 112 urges the mandrel 124 and blade piston 126 downward, thereby compressing the spring acting on the blade piston 126. The blade piston 126 acts on the blades 116*a,b,* thereby actuating the blades 116*a,b* into an extended position. FIG. 5A shows the blades 116*a,b* extending toward the inner tubular 50. In this example, the upper lips of the shoulder 126*a* act on a corresponding shoulder of each blade 116*a,b,* thereby causing each blade 116*a,b* to rotate about its respective pin 120. In turn, each blade 116*a,b* is at least partially extended through the corresponding window formed in the housing section 15*d*. As each blade 116*a,b* extends towards the inner tubular 50, the center of gravity of the blade 116*a* may move laterally from a first side of the corresponding pin 120 to an alternate side of the pin 120. Likewise, at least a portion 206*a* of the cutting surface 206 may move laterally from a first side of the corresponding pin 120 to an alternate side of the pin 120. For example, at least a portion 206*a* of the cutting surface 206 may move laterally towards the pin 120 as the blade 116*a* begins extending outward. In turn, the portion of the cutting surface 206 may move laterally past the pin 120. Next, the portion 206*a* of the cutting surface 206 may move laterally outward away from the pin 120, as the blade 116*a* continues extending. The portion 206*a* of the cutting surface 206 may be disposed laterally between the longitudinal axis B and a parallel axis through the pin 120. In turn, the portion 206*a* of the cutting surface 206 may move through and/or past the parallel axis through the pin 120, as the blade 116*a* continues extending outward. As would be apparent to one of ordinary skill in the art with the benefit of this disclosure, actuation assembly 30 can be other than hydraulic while still being capable of selectively extending blades 116*a,b* of the blade assembly 40. For example, actuation assembly 30 could be an electromagnetic device.

Figure 5C:
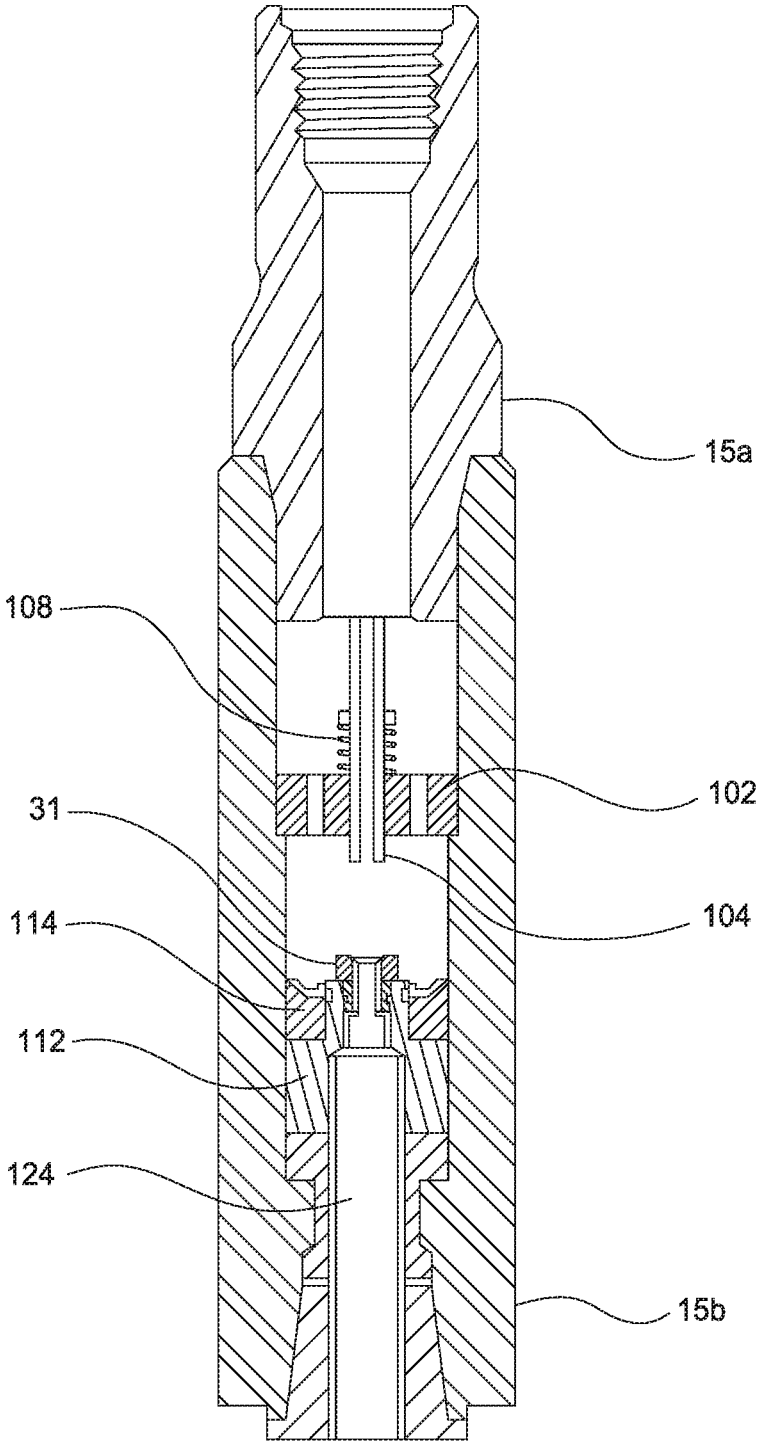
FIG. 5C illustrates a cross-sectional view of the actuation assembly of the tool.

In one embodiment, the tool 10 provides an indication at the surface of the wellbore 20 that the blades 116*a,b* have cut through the inner tubular 50. For example, the actuation assembly 30 is configured such that the movable member 104 and the actuator piston 112 disengage when the blades 116*a,b* cut through the wall of the inner tubular 50. Upon cutting through the inner tubular 50, the movable member 104 reaches a stop and the fluid acting on the piston surface of the actuator piston 112 causes the actuator piston 112 to move downward relative to the movable member 104. As a result, the actuator piston 112 disengages from the bottom surface of the movable member, as shown in FIG. 5C. In turn, the second portion of the injected fluid enters the bore of the actuator piston 112 and causes the fluid pressure in the housing 15 to decrease. In one embodiment, the pressure drop corresponds to the blades having extended to a predetermined cutting radius which corresponds to having cut through the inner tubular 50. In another embodiment, the tool 10 provides an indication at the surface of the wellbore 20 that the blades 116*a,b* have extended to a predetermined cutting radius which corresponds to having cut through the inner tubular 50 and the outer tubular 60, as shown in FIG. 5B. In another embodiment, the pressure drop corresponds to the blades 116*a,b* having cut through both the inner tubular 50 and the outer tubular 60. In another embodiment, the tool 10 provides an indication at the surface of the wellbore 20 that the blades 116*a,b* have cut through three or more nested tubulars. In another embodiment, the pressure drop corresponds to the blades 116*a,b* having cut through three or more nested tubulars. In another embodiment, the pressure drop corresponds to the blades 116*a,b* being perpendicularly positioned relative to the inner tubular 50. In another embodiment, the pressure drop corresponds to the blades 116*a,b* having reached a fully extended position, as shown in FIG. 5B. As would be apparent to one of ordinary skill in the art with the benefit of this disclosure, actuation assembly 30 can be other than hydraulic while still being capable of providing an indication at the surface of the wellbore 20 that the blades 116*a,b* have cut through the inner tubular 50 and responding appropriately. For example, the actuation assembly 30 may be at least partially disposed below the blade assembly 40. The actuation assembly 30 may be configured to push upwards against an outer surface of the blade body 200, urging the blades 116*a,b* to the extended position. An exemplary actuation assembly is disclosed in U.S. Pat. No. 5,201,817, which is hereby fully incorporated by reference.

Upon indication that the blades 116*a,b* have completed the cutting operation, the blades 116*a,b* are returned to the retracted position. In some embodiments, to return the blades 116*a,b* to the retracted position, fluid pressure in the housing 15 may be decreased. As a result, the spring acting on the blade piston 126 may overcome the fluid force acting on the packing seal 114. The blade piston 126 is urged upwards, thereby engaging the blades 116*a,b* with the lower lips of the shoulder 126*a*. In turn, the actuator piston 112 is urged upwards into engagement with the bottom surface of the movable member 104. By moving upwards, the blade piston 126 urges the blades 116*a,b* into the retracted position. The blades 116*a,b* pivot about the pin 120 to the retracted position, as shown in FIG. 3C. The blades 116*a,b* may scissor together and overlap in the retracted position. In one embodiment, the curved portion 204 of a first blade may face laterally in a first direction. The curved portion 204 of a second blade may face laterally in a second direction. The second direction may be opposite of the first direction. For example, the blades 116*a,b* may be disposed adjacent and/or side-by-side in the housing section 15*d* in the retracted position. In one embodiment, a first blade may be disposed laterally in a first direction from the longitudinal axis B of the housing section 15*d*. A second blade may be disposed laterally in a second direction from the longitudinal axis B of the housing section 15*d*. The second direction may be opposite of the first direction. The portion 206*a* of the cutting surface 206 of the first blade may be disposed on a second side of the longitudinal axis B of the housing 15 in the retracted position, as shown in FIG. 3C. The portion 206*a* of the cutting surface 206 of the first blade may be disposed on the first side of the longitudinal axis B of the housing 15 in the extended position, as shown in FIG. 5B. The cutting surface 206 may be disposed at least in part on the second side of the longitudinal axis B of the housing 15 in the retracted position, as shown in FIG. 3C. The corresponding pin 120 of the blade may be laterally disposed on the second side of the longitudinal axis B of the housing 15. In one embodiment, the corresponding curved portions 204 of the blades 116*a,b* may overlap in the retracted position. For example, the curved portion 204 of a first blade may extend past the curved portion 204 of a second blade in the retracted position.

In another embodiment, the stabilizer assembly 70, the mandrel 124, the blade piston 126, and the spring acting on the blade piston 126 may be omitted. The actuator piston 112 may include a shoulder substantially similar to shoulder 126*a* of the blade piston 126. The actuator piston 112 may be biased upwards against the bottom surface of the movable member 104 by a spring. The actuator piston 112 may be configured to move the blades 116*a,b* between the extended position and the retracted position. The actuator piston 112 acts on the blades 116*a,b,* thereby actuating the blades 116*a,b* into the extended position. The upper lips of the shoulder of the actuator piston 112 act on a corresponding shoulder of the blades 116*a,b,* thereby causing each blade 116*a,b* to rotate about its respective pin 120. In some embodiments, to return the blades 116*a,b* to the retracted position, fluid pressure in the housing 15 may be decreased. As a result, the spring of the actuator piston 112 may overcome the fluid force acting on the packing seal 114. The actuator piston 112 is urged upwards into engagement with the bottom surface of the movable member 104. In turn, the actuator piston 112 urges the blades 116*a,b* into the retracted position. The blade 116*a* may pivot about the pin 120 to the retracted position. The blades 116*a,b* may scissor together and overlap in the retracted position. In one embodiment, the first blade may move laterally towards the second blade while moving from the extended position to the retracted position. The first blade may move laterally past at least a portion of the second blade when moving from the extended position to the retracted position. The cutting surface of the first blade may move laterally past at least a portion of the cutting surface of the second blade when the blades move from the extended position to the retracted position.

In one embodiment, the tool 10 is rotated relative to the inner tubular 50 while the blades 116*a,b* are extending toward the inner tubular 50. In one embodiment, a mud motor rotates the tool 10.

In one embodiment, the actuation assembly 30 provides an evenly distributed cut by actuating the blades 116*a,b* into an extended position, as shown in FIG. 5A. For example, the blade piston 126 of the actuation assembly 30 may provide a substantially equal (within +/− 10 percent) force on the shoulder of each blade 116*a,b* such that each blade 116*a,b* engages the inner tubular 50 with a substantially equal radial force. The radial forces from the blades 116*a,b* may cause the tool 10 to move laterally, thereby causing each blade 116*a,b* to engage the inner tubular 50. For example, in the event that tool 10 is not centralized in inner tubular 50, the radial forces from the blades 116*a,b* engaging with inner tubular 50 may cause the tool 10 to move laterally, thereby repositioning the tool 10 to be more centralized in inner tubular 50.

In one embodiment, the blades 116*a,b* may be mechanically retracted from the extended position. In some instances, the blades 116*a,b* may become stuck or pinched during a cutting operation. For example, one of the nested tubulars may fall and pinch or land on the blades 116*a,b,* causing a lockup and preventing further cutting. In certain instances, the spring acting on the blade piston 126 may not be able to overcome the frictional force on the blades 116*a,b* to move the blades 116*a,b* from the extended position to the retracted position. In one embodiment, a longitudinal force may be applied to the tool 10 in order to retract the blades 116*a,b*. For example, the tool 10 may be lifted or pulled upwards from the surface to free the blades 116*a,b* from the stuck or pinched condition and move the blades from the extended position to the retracted position. In turn, the uncut material (e.g., tubulars, cement) adjacent the blades 116*a,b* will urge the blades 116*a,b* towards the retracted position. The spring acting on the blade piston 126 may assist the longitudinal force on the tool 10 in retracting the blades 116*a,b*.

In one embodiment, the blades 116 may be retracted and the cutting operation described herein may be repeated any number of times. For example, the tool 10 may be moved axially upward in the wellbore 20 and the nested tubulars may be cut at the new position.

In one or more of the embodiments described herein, a tool for cutting a tubular in a wellbore includes a housing, a first blade having a first cutting surface, and a second blade having a second cutting surface.

In one or more of the embodiments described herein, the first blade and the second blade are configured to move between an extended position and a retracted position.

In one or more of the embodiments described herein, the first blade and the second blade are disposed in the housing in the retracted position.

In one or more of the embodiments described herein, the first cutting surface and the second cutting surface overlap in the retracted position.

In one or more of the embodiments described herein, the first blade includes a first curved portion, the first cutting surface disposed on at least a part of the first curved portion.

In one or more of the embodiments described herein, the second blade includes a second curved portion, the second cutting surface disposed on at least a part of the second curved portion.

In one or more of the embodiments described herein, the first curved portion and the second curved portion are substantially semi-circular.

In one or more of the embodiments described herein, the first curved portion extends laterally past the second curved portion in the retracted position.

In one or more of the embodiments described herein, the first curved portion is an arcuate segment.

In one or more of the embodiments described herein, the second curved portion is an arcuate segment.

In one or more of the embodiments described herein, the first blade is configured to rotate about a first pin.

In one or more of the embodiments described herein, the second blade is configured to rotate about a second pin.

In one or more of the embodiments described herein, the tool further includes a window formed through a wall of the housing, the first blade configured to extend at least partially through the first window in the extended position.

In one or more of the embodiments described herein, the first cutting surface and the second cutting surface overlap laterally in the retracted position.

In one or more of the embodiments described herein, a tool for cutting a tubular in a wellbore includes a housing and a blade configured to move between an extended position and a retracted position.

In one or more of the embodiments described herein, the blade includes a curved portion having a cutting surface disposed on at least a part of the curved portion.

In one or more of the embodiments described herein, the radius of curvature of the curved portion is substantially similar to an outer diameter of the housing.

In one or more of the embodiments described herein, the radius of curvature is substantially uniform.

In one or more of the embodiments described herein, the cutting surface includes a radius of curvature, the radius of curvature of the curved portion greater than the radius of curvature of the cutting surface.

In one or more of the embodiments described herein, the blade further includes an initial engagement point configured to engage the tubular.

In one or more of the embodiments described herein, the cutting surface faces laterally inward of the housing in the retracted position.

In one or more of the embodiments described herein, the radius of curvature varies along the curved portion.

In one or more of the embodiments described herein, the blade is substantially semi-circular.

In one or more of the embodiments described herein, the radius of curvature of the cutting surface varies along the cutting surface.

In one or more of the embodiments described herein, a tool for cutting a tubular in a wellbore includes a housing, a first blade having a first cutting surface and configured to move between an extended position and a retracted position, and a second blade having a second cutting surface and configured to move between an extended position and a retracted position, wherein the first cutting surface faces inward of the housing towards the second cutting surface in the retracted position.

In one or more of the embodiments described herein, the first blade and the second blade are disposed adjacent in the housing in the retracted position.

In one or more of the embodiments described herein, a tool for cutting a tubular in a wellbore includes a housing having a first window and a second window formed through a wall of the housing, a pin disposed adjacent the first window, and a blade configured to rotate about the pin between an extended position and a retracted position, the blade having a curved portion disposed adjacent the second window in the retracted position.

In one or more of the embodiments described herein, a method of cutting a tubular includes positioning a rotatable cutting tool in the tubular, the cutting tool having a housing and a blade with a cutting surface disposed thereon, rotating the blade about a pin through a window formed in the housing, rotating the cutting tool relative to the tubular, and cutting the tubular using the cutting surface.

In one or more of the embodiments described herein, a method of cutting a tubular includes positioning a rotatable cutting tool in the tubular, the rotatable cutting tool having a housing and a blade with a cutting surface disposed thereon.

In one or more of the embodiments described herein, the method further includes moving the blade between a retracted position, wherein at least a portion of the cutting surface is disposed on a first side of a longitudinal axis of the housing, and an extended position, wherein the portion of the cutting surface is disposed on a second side of the longitudinal axis.

In one or more of the embodiments described herein, the method further includes rotating the cutting tool relative to the tubular.

In one or more of the embodiments described herein, the method further includes cutting the tubular using the cutting surface.

In one or more of the embodiments described herein, the method further includes stabilizing the cutting tool by engaging the tubular with a stabilizer.

In one or more of the embodiments described herein, the method further includes cutting a second tubular surrounding the tubular.

In one or more of the embodiments described herein, moving the blade further includes rotating the blade about a pin.

In one or more of the embodiments described herein, the pin is disposed in the housing on the second side of the longitudinal axis.

In one or more of the embodiments described herein, the housing has a longitudinal axis.

In one or more of the embodiments described herein, a pin is connected to the housing and disposed on a first side of the longitudinal axis.

In one or more of the embodiments described herein, a blade is configured to move between an extended position and a retracted position about the pin.

In one or more of the embodiments described herein, the blade includes a cutting surface disposed thereon, wherein the cutting surface is disposed at least in part on a second side of the longitudinal axis in the retracted position.

In one or more of the embodiments described herein, a method of cutting a tubular includes positioning a rotatable cutting tool in the tubular, the cutting tool having a housing and a blade, the blade including a cutting surface disposed thereon.

In one or more of the embodiments described herein, the method further includes moving the blade between a retracted position, wherein at least a portion of the cutting surface is disposed on a first side of a longitudinal axis of the housing, and an extended position, wherein the portion of the cutting surface is disposed on a second side of the longitudinal axis.

In one or more of the embodiments described herein, the method further includes rotating the cutting tool relative to the tubular.

In one or more of the embodiments described herein, the method further includes cutting the tubular using the blade.

In one or more of the embodiments described herein, a method of cutting a tubular includes positioning a rotatable cutting tool in the tubular, the cutting tool having a housing and a blade, the blade including a cutting surface disposed thereon; moving a portion of the cutting surface of the blade between a first side of a longitudinal axis of the housing and a second side of the longitudinal axis; rotating the cutting tool relative to the tubular; and cutting the tubular using the blade.

As will be understood by those skilled in the art, a number of variations and combinations may be made in relation to the disclosed embodiments all without departing from the scope of the invention. While the foregoing is directed to embodiments of the present invention, other and further embodiments of the invention may be devised without departing from the basic scope thereof, and the scope thereof is determined by the claims that follow.

The invention claimed is:

1. A tool for cutting a tubular in a wellbore, comprising:

a housing including a central axis, the housing further including a first window on a first side of the central axis and a second window on a second side of the central axis opposite of the first side;

a first blade having a first cutting surface, the first blade including:

a first section, wherein the first section is pivotally mounted to a first pin within the housing, the first pin being disposed on the first side of the central axis;

a second section; and a third section including an end of the first blade; and a second blade pivotally mounted to a second pin within the housing, the second pin being disposed on the second side, the second blade having a second cutting surface, the second blade including:

a first section, wherein the first section is pivotally mounted to a second pin within the housing, the second pin being disposed on the second side of the central axis:

a second section; and a third section including an end of the second blade;

wherein:

the first blade and the second blade are both configured to move between a retracted position in which the first and second blades are positioned entirely within the housing and an extended position in which the first and second blades extend out of the housing;

when the first and second blades are in the retracted position, the second section of the first blade is laterally positioned on the second side of the central axis, and the second section of the second blade is laterally positioned on the first side of the central axis; and when the first and second blades move from the retracted position to the extended position, at least a portion of the second section of the first blade moves past the central axis and out of the first window, and at least a portion of the second section of the second blade moves past the central axis and out of the second window.

2. The tool of claim 1, further comprising:

the first blade having a first curved portion, the first cutting surface disposed on at least a part of the first curved portion; and the second blade having a second curved portion, the second cutting surface disposed on at least a part of the second curved portion.

3. The tool of claim 2, wherein the first curved portion and the second curved portion are substantially semi-circular.

4. The tool of claim 2, wherein:

the first curved portion is an arcuate segment; and the second curved portion is an arcuate segment.

5. A method of cutting a tubular, comprising:

positioning a rotatable cutting tool in the tubular, the cutting tool having:

a housing including a central axis, the housing further including a first window on a first side of the central axis and a second window on a second side of the central axis opposite of the first side, a first blade having a first cutting surface, the first blade including:

a first section, wherein the first section is pivotally mounted to a first pin within the housing, the first pin being disposed on the first side of the central axis;

a second section; and a third section including an end of the first blade;

a second blade having a second cutting surface, the second blade including:

a first section, wherein the first section is pivotally mounted to a second pin within the housing, the second pin being disposed on the second side of the central axis;

a second section; and a third section including an end of the second blade;

moving the first and second blades from a retracted position in which the first and second blades are positioned entirely within the housing to an extended position in which the first and second blades extend out of the housing;

rotating the cutting tool relative to the tubular; and cutting the tubular using the first blade and the second blade, wherein:

when the first and second blades are in the retracted position, the second section of the first blade is laterally positioned on the second side of the central axis and the second section of the second blade is laterally positioned on the first side of the central axis, and when the first and second blades move from the retracted position to the extended position, at least a portion of the second section of the first blade moves past the central axis and out of the first window, and at least a portion of the second section of the second blade moves past the central axis and out of the second window.

6. The method of claim 5, further comprising stabilizing the cutting tool by engaging the tubular with a stabilizer.

7. The method of claim 5, further comprising cutting a second tubular surrounding the tubular.

8. The method of claim 5, extending the blades further comprising rotating the first and second blades about a first and second pin.

9. A tool for cutting a tubular in a wellbore, comprising:

a housing;

a first blade having a first cutting surface, the first blade including:

a first section, wherein the first section is pivotally mounted to a first pin within the housing, the first pin being disposed on a first side of a central axis of the housing;

a second section; and a third section including an end of the first blade; and a second blade having a second cutting surface, the second blade including:

a first section, wherein the first section is pivotally mounted to a second pin within the housing, the second pin being disposed on a second side of the central axis opposite the first side;

a second section; and a third section including an end of the second blade;

wherein:

the first blade and the second blade are both configured to move between a retracted position in which the first and second blades are positioned entirely within the housing and an extended position in which the third sections and at least a portion of the second sections of the first and second blades extend out of the housing;

when the first and second blades are in the retracted position, the second section of the first blade is laterally positioned on the second side of the central axis, and the second section of the second blade is laterally positioned on the first side of the central axis; and when the first blade and the second blade move between the retracted and extended positons, the first pin and the second pin do not move relative to the housing.

* * * * *